US009461420B2

(12) United States Patent
Hirota

(10) Patent No.: US 9,461,420 B2
(45) Date of Patent: Oct. 4, 2016

(54) CONNECTOR HOLDER

(71) Applicant: Sumitomo Wiring Systems, Ltd., Yokkaichi, Mie (JP)

(72) Inventor: Masanori Hirota, Mie (JP)

(73) Assignee: SUMITOMO WIRING SYSTEMS, LTD. (JP)

( * ) Notice: Subject to any disclaimer, the term of this patent is extended or adjusted under 35 U.S.C. 154(b) by 0 days.

(21) Appl. No.: 14/870,132

(22) Filed: Sep. 30, 2015

(65) Prior Publication Data

US 2016/0099509 A1 Apr. 7, 2016

(30) Foreign Application Priority Data

Oct. 1, 2014 (JP) ..... 2014-202898

(51) Int. Cl.

| | |
|---|---|
| ***H01R 9/05*** | (2006.01) |
| ***H01R 24/52*** | (2011.01) |
| ***H01R 13/74*** | (2006.01) |
| *H01R 27/02* | (2006.01) |

(52) U.S. Cl.

CPC ..... *H01R 24/52* (2013.01); *H01R 13/743* (2013.01); *H01R 27/02* (2013.01)

(58) Field of Classification Search

CPC ..... H01R 9/05; H01R 13/743; H01R 27/02; H01R 24/52

USPC ..... 439/578–585, 63, 675, 620.03, 944; 174/74 R

See application file for complete search history.

(56) References Cited

U.S. PATENT DOCUMENTS

| | | | | |
|---|---|---|---|---|
| 4,797,121 | A * | 1/1989 | Hayward | H01R 24/547 439/579 |
| 6,776,656 | B2 * | 8/2004 | Lehtonen | H01R 9/0515 439/578 |
| 7,008,256 | B2 * | 3/2006 | Poiraud | H01R 9/053 439/394 |
| 7,052,283 | B2 * | 5/2006 | Pixley | H01R 24/42 336/92 |
| 7,198,491 | B2 * | 4/2007 | Butler | H01R 24/52 439/569 |
| 7,980,894 | B1 | 7/2011 | Hall et al. | |
| 8,052,489 | B2 | 11/2011 | Mase et al. | |
| 2013/0203288 | A1 * | 8/2013 | Hosler, Sr. | H01R 24/542 439/582 |

FOREIGN PATENT DOCUMENTS

| | | |
|---|---|---|
| JP | 2010-129527 | 6/2010 |
| JP | 2012-43798 | 3/2012 |

* cited by examiner

*Primary Examiner* — Edwin A. Leon
(74) *Attorney, Agent, or Firm* — Gerald E. Hespos; Michael J. Porco; Matthew T. Hespos

(57) ABSTRACT

It is aimed to provide a connector holder enabling a connector for connecting a coaxial cable and a connector for connecting a wire different in type from the coaxial cable to commonly use a panel hole. A connector holder (10) integrally includes a first fixing portion (20) to which a first connector (50) for connecting a coaxial cable (C) and second fixing portions (40) to which second connectors for connecting wires (W) different in type from the coaxial cable (C) are to be fixed. According to this configuration, the first connector (50) for connecting the coaxial cable (C) and the second connectors for connecting the wires (W) different in type from the coaxial cable (C) are fixed to one panel hole via one connector holder (10).

11 Claims, 13 Drawing Sheets

CONNECTOR HOLDER

BACKGROUND

1. Field of the Invention

The invention relates to a connector holder.

2. Description of the Related Art

Japanese Unexamined Patent Publication No. 2012-43798 discloses a connector for connecting a coaxial cable, and Japanese Unexamined Patent Publication No. 2010-129527 discloses a connector for connecting a wire different from a coaxial cable. Generally, these connectors are locked and fixed to separate panel holes via connector holders or directly, for example, in the case of being fixed to a panel of a vehicle. However, the panel holes tend to be large openings as compared with the outer shapes of the connectors. It is not preferable to provide separate panel holes for reasons, such as ensuring strength. Thus, measures against providing separate panel holes for different types of connectors have been desired.

The invention was completed based on the above situation and aims to provide a connector holder enabling a connector for connecting a coaxial cable and a connector for connecting a wire different in type from the coaxial cable to use a common panel hole.

SUMMARY

The invention relates to a connector holder that integrally includes a first fixing portion to which a first connector for connecting a cable is to be connected, and a second fixing portion to which a second connector for a wire different from the coaxial cable is to be fixed.

The first connector for connecting the coaxial cable and the second connector for connecting the wire different from the coaxial cable are fixed to one panel hole via one connector holder. Therefore the panel hole can be used commonly by the first connector for connecting the coaxial cable and the second connector for connecting the wire different from the coaxial cable.

The connector holder of the present invention may have the first fixing portion arranged in parallel between two of the second fixing portions, and may be shaped symmetrically in an arrangement direction of the fixing portions. According to this configuration, the connector holder can be used by being reversed in the arrangement direction of the fixing portions.

The first fixing portion may be open forward and backward. Additionally, the first connector may include first and second connectors that are connectable to each other. The first connector may be inserted into the first fixing portion from behind when connected to an end part of the coaxial cable and may be pulled back and fixed to the first fixing portion by pulling the coaxial cable back after projecting forward of the first fixing portion. The first connector and the first fixing portion may include rails for guiding the first connector to a predetermined fixed position of the first fixing portion by being engaged with each other when the first connector is pulled back. Accordingly, the first connector is guided to the predetermined fixed position by the rails when being pulled back. Thus, the first connector can be fixed easily.

The connector holder may be configured so that the rail structures include a rail with a groove open sideways and an insertion portion to be inserted into the groove. The rail is provided in the first fixing portion and the insertion portion is provided on the first connector. The rail includes a stop for restricting backward separation of the first connector from the first fixing portion by the contact of the insertion portion therewith when the first connector is pulled back and reaches the predetermined fixed position. Contact between the insertion portion and the stop restricts backward separation of the first connector. Thus, the first connector can be fixed easily.

The first connector and the first fixing portion may include lock structures for restricting forward separation of the first connector from the first fixing portion by being engaged with each other when the first connector is pulled back and reaches the predetermined fixed position. The lock structures are locked to restrict forward separation of first connector when the pulled-back first connector reaches the predetermined fixed position. Thus, the first connector can be fixed easily.

The lock structures may include a lock projection on the first connector and a lock piece in the first fixing portion. The lock projection may move over the lock piece and the lock piece resiliently returns to lock the lock projection when the lock projection comes contacts the lock piece to displace the lock piece resiliently and the first connector reaches the predetermined fixed position in pulling back the first connector. Accordingly, the lock piece and the lock projection are locked automatically to restrict forward separation of the first connector when the pulled-back first connector reaches the predetermined fixed position. Thus, the first connector can be fixed easily.

The lock piece may be cantilevered forward from a front part of the first fixing portion. The rail may be provided on a wall surface of the first fixing portion on a side where the lock piece is formed and may include a standing portion standing on the wall surface and a protruding portion protruding sideways from an end part of the standing portion in a standing direction and extending from a position behind the lock piece to a position overlapping with the lock piece. The standing portion may have a slit to separate the lock piece and the protruding portion. According to this configuration, the lock piece and the rail are separated by the slit in the standing portion, although the rail extends up to the position overlapping with the lock piece. Thus, it is possible to ensure a sufficient deflection margin of the lock piece and a guide margin of the rail.

A guide may be provided on a front opening of the first fixing portion. The guide may incline to narrow a width of the first fixing portion from the front to the rear and may be configured to guide a movement of the first connector to the predetermined fixed position. According to this configuration, the first connector contacts the guide to have the movement thereof to the predetermined fixed position guided when being pulled back from a position before the first fixing portion. Thus, the first connector can be easily pulled back to a predetermined position.

DETAILED DESCRIPTION

Figure 1:
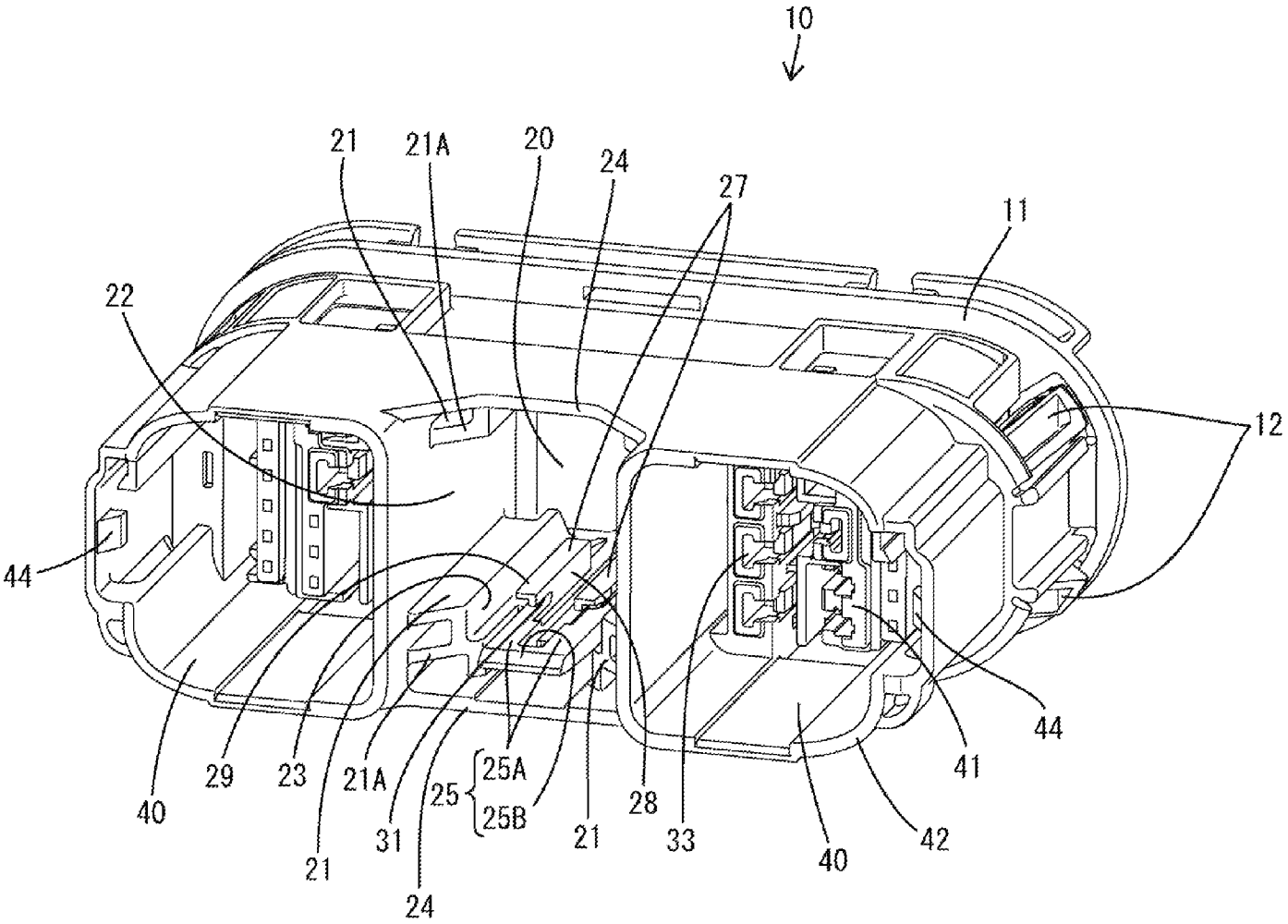
FIG. 1 is a perspective view showing a connector holder in a first embodiment.

A connector holder in accordance with an embodiment of the invention is identified by the numeral 10 in the figures. The connector 10 is made of synthetic resin and integrally includes a first fixing portion 20 to which a first connector 50 for connecting a coaxial cable is to be fixed and second fixing portions 40 to which second connectors (not shown) for connecting wires different in type from the coaxial cable C are to be fixed.

The first fixing portion 20 is arranged in parallel between two second fixing portions 40, and is symmetrical in an arrangement direction of the fixing portions. In the following description, a left front side and a right back side of FIG. 1 are referred to as a front side and a rear side and upper and lower sides are referred to as upper and lower sides in each constituent member.

A jaw 11 to be arranged on one surface side of an unillustrated panel and claws 12 to be arranged on the other surface side of the panel are provided on the outer peripheral surface of the connector holder 10. The claws 12 are cantilevered resiliently to displace inward and outward. When the connector holder 10 is mounted into a panel hole, the claws 12 contact a peripheral edge part of the panel hole to displace resiliently in. When passing through the panel hole, the claws 12 resiliently return outward to be locked to the other surface side of the panel. In this way, the claws 12 and the jaw 11 sandwich the peripheral edge part of the panel and the connector holder 10 is mounted on the panel.

Figure 9:
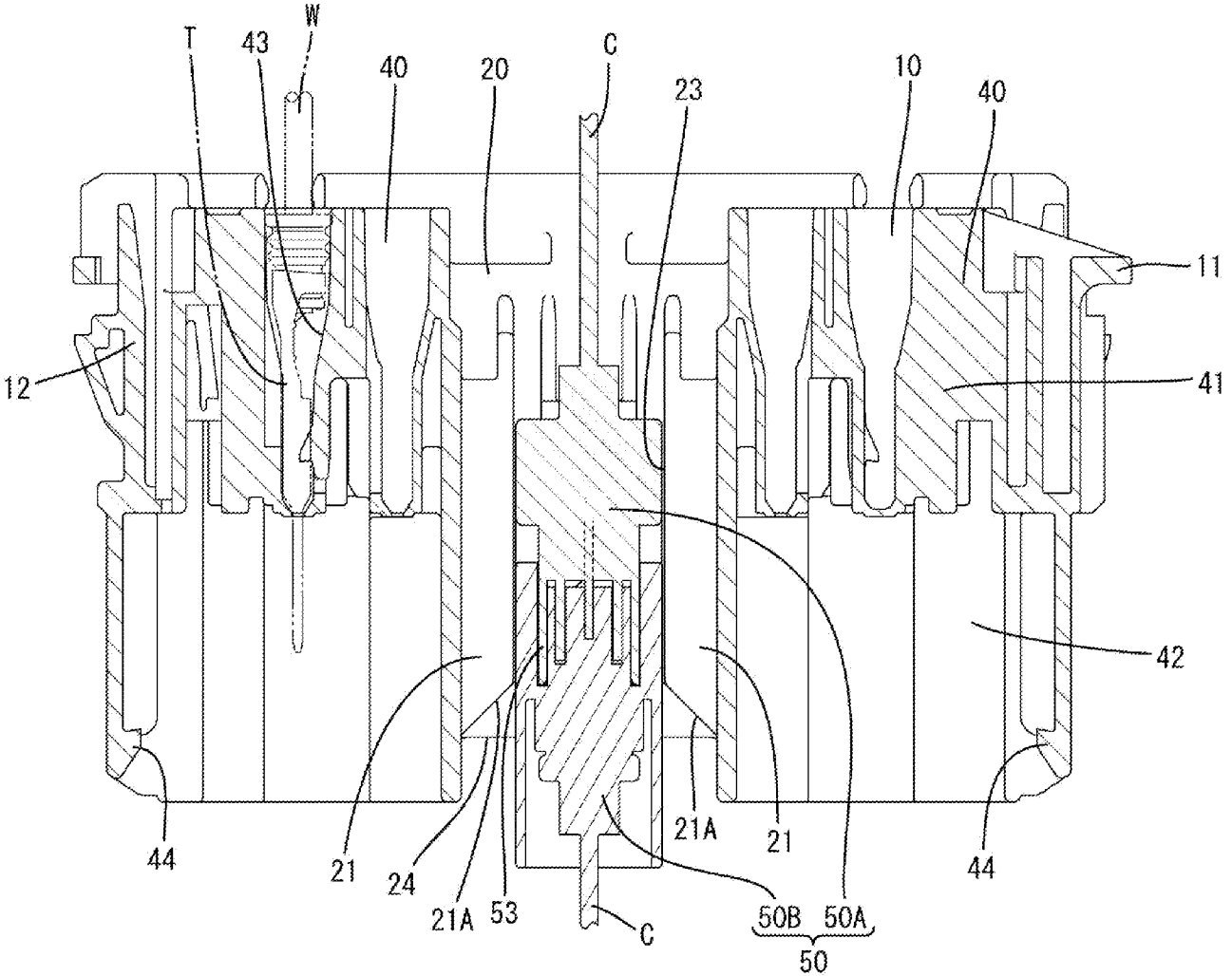
FIG. 9 is a plan view in section showing the state where the connected first connector is fixed to the first fixing portion.

As shown in FIG. 9, the second fixing portion 40 includes a housing 41 into which terminal fittings T fixed to ends of wires W are to be accommodated and a receptacle 42 into which a second connector holding mating terminal fittings fixed to ends of unillustrated wires can fit.

The housing 41 is provided with cavities 43 capable of accommodating the terminal fittings T. The receptacle 42 is substantially in the form of a rectangular tube projecting forwardly of the housing 41 and a protrusion 44 for holding the second connector in a locked state projects on the inner peripheral surface of the housing 41. The protrusions 44 are provided on opposite widthwise end parts of the connector holder 10.

The first connector 50 is a high-frequency connector adapted to FAKRA and has two connectors (hereinafter, referred to as a plug 50A and a jack 50B) connectable to each other. The first connector 50 is connected after the plug 50A connected to an end part of the coaxial cable C is inserted into the first fixing portion 20 from behind and caused to project forwardly of the first fixing portion 20. Then, the connected first connector 50 is pulled back and fixed to the first fixing portion 20 by pulling the coaxial cable C of the plug 50A. The first connector 50 is held in a connected state by locking a lock 51 on the plug 50A and a lock arm 52 on the jack 50B together.

Figure 6:
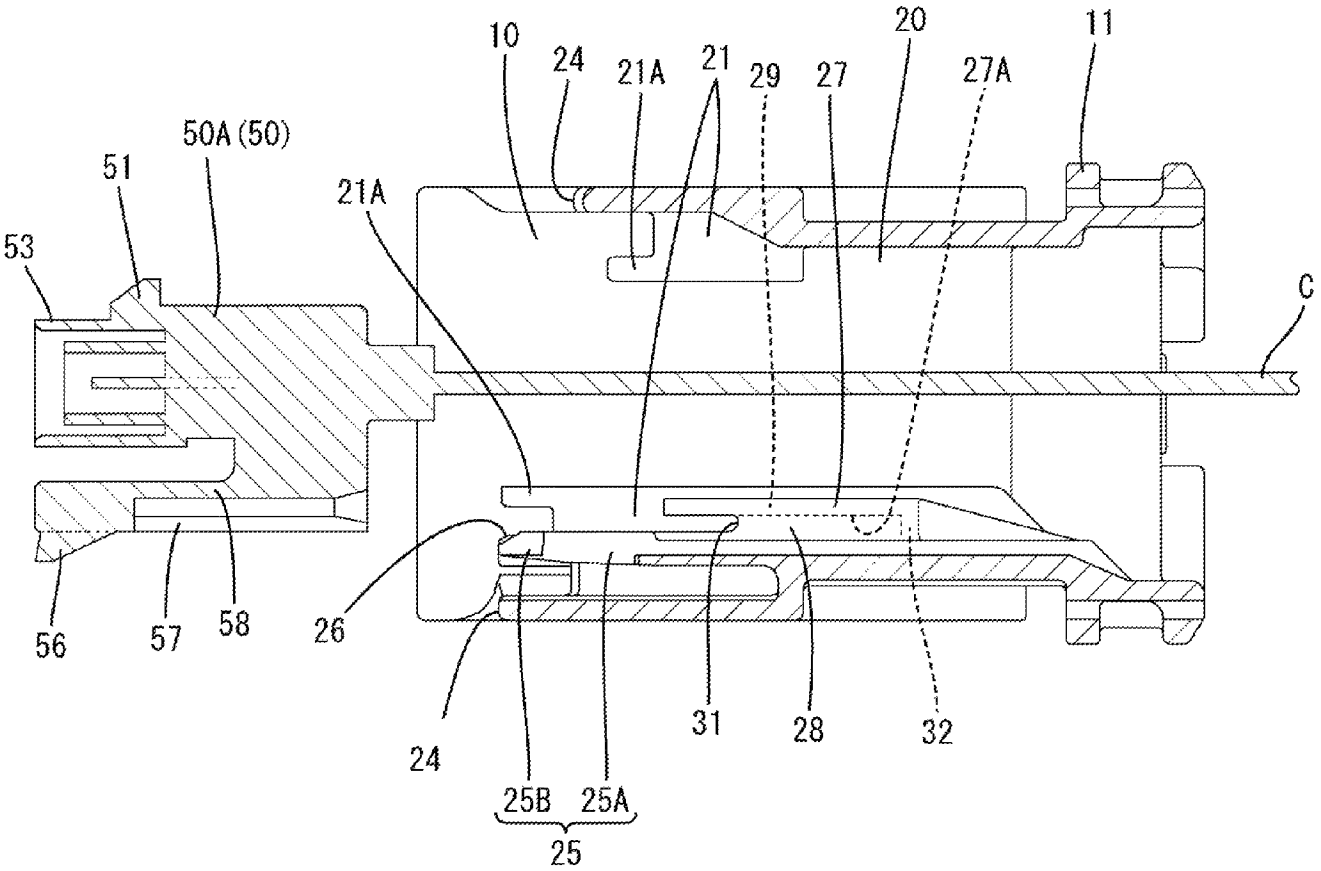
FIG. 6 is a section showing a plug is inserted to project forward of the first fixing portion.

As shown in FIG. 6, the lock 51 projects on the upper surface of a hollow cylindrical connecting tube 53 provided in the plug 50A.

The lock arm 52 is provided on the upper surface of the jack 50B and resiliently deflectable in a seesaw-like manner with a coupling 54 as a support. An operating portion 55 to be pressed in releasing the connected state of the first connector 50 is provided on a rear part of the lock arm 52.

Figure 7:
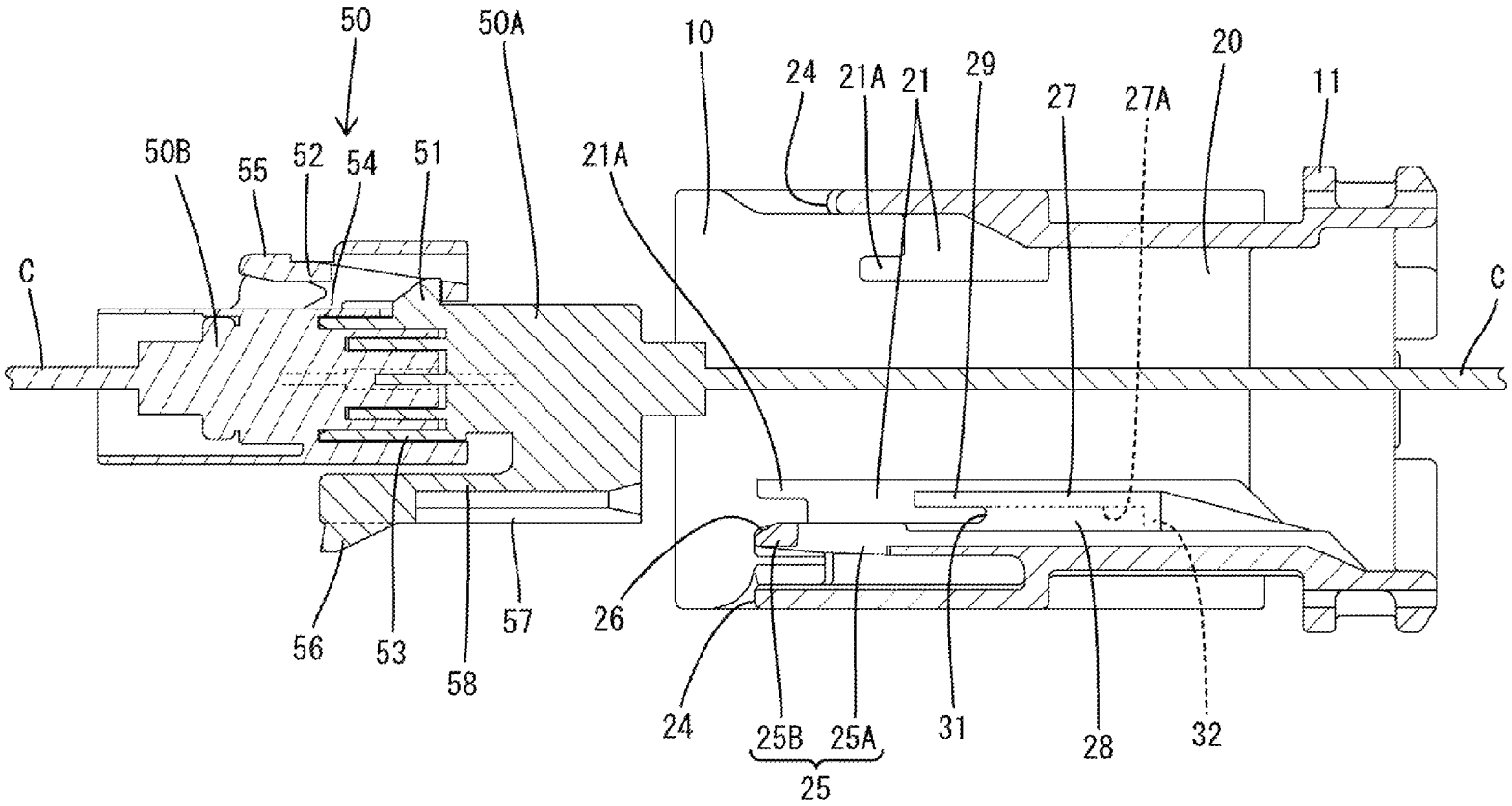
FIG. 7 is a section showing a state where a first connector is connected.
Figure 8:
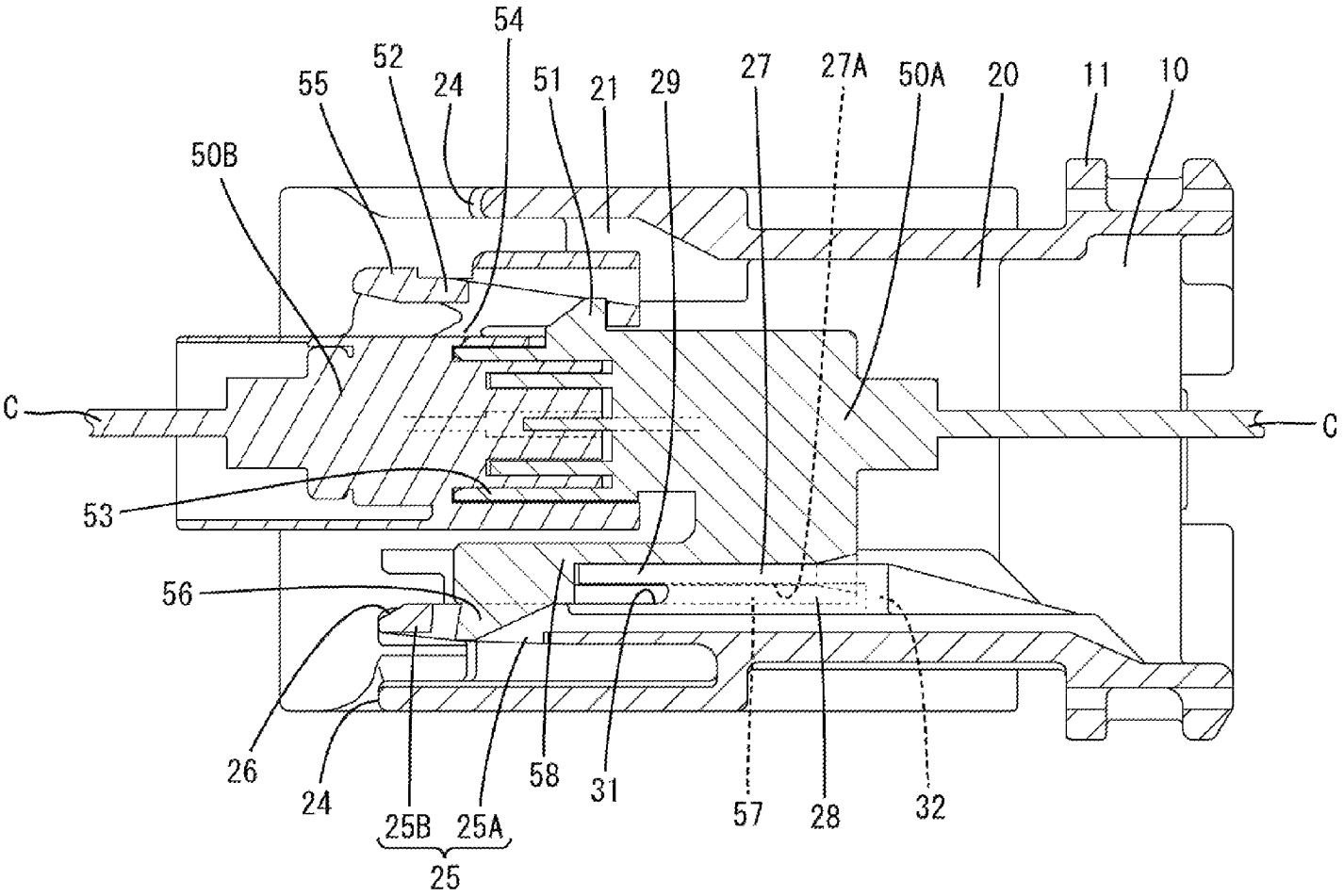
FIG. 8 is a side view in section showing the connected first connector fixed to the first fixing portion.

As shown in FIG. 7, the plug 50A is provided with a lock projection 56 to be locked to a lock piece 25 provided in the first fixing portion 20 when the plug 50A is pulled back to a predetermined fixed position of the first fixing portion 20. As shown in FIG. 8, the lock projection 56 projects on the lower surface of a base 58. The lock projection 56 is provided in a substantially widthwise center of the front end of the base 58.

Figure 10:
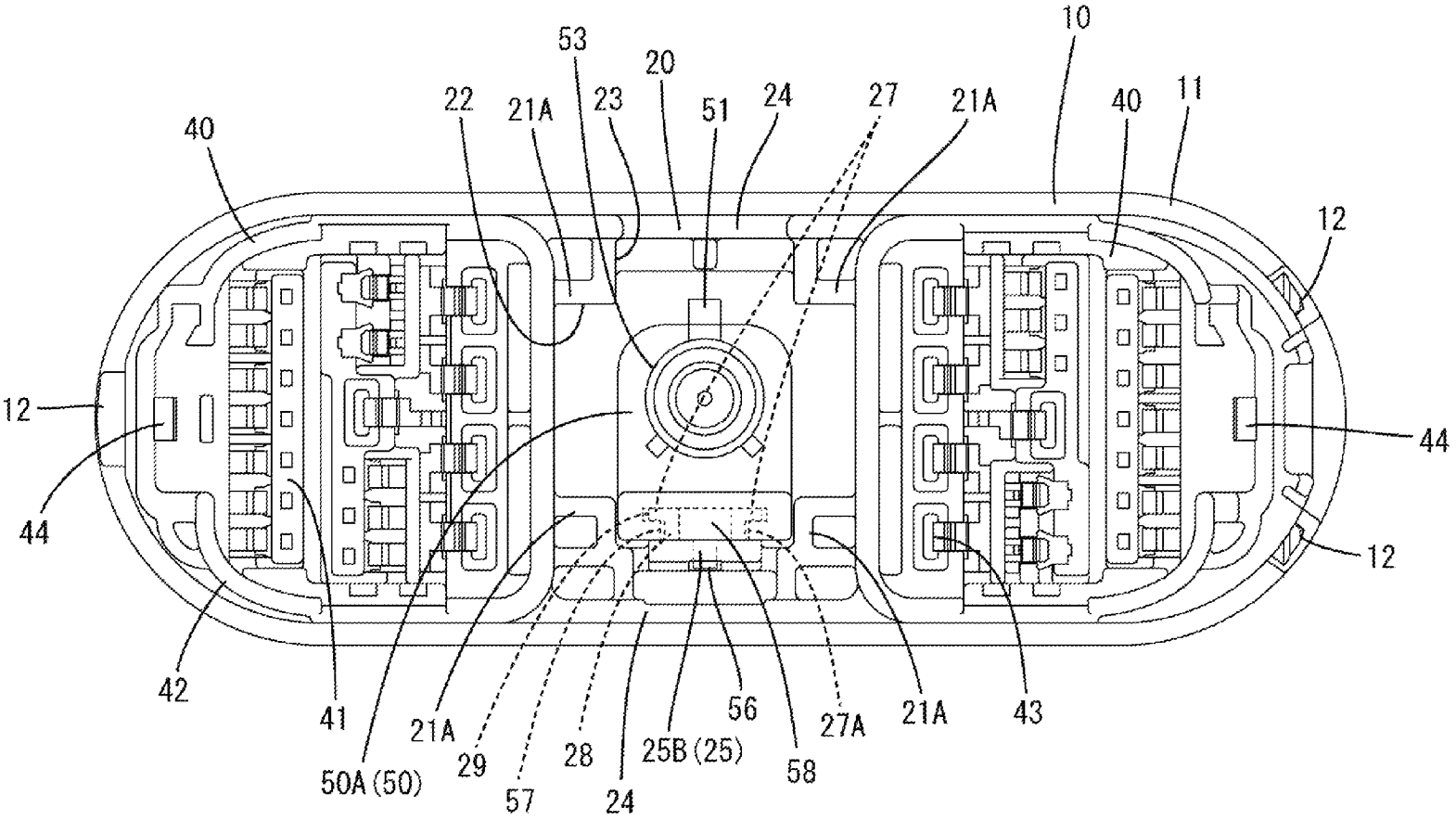
FIG. 10 is a front view showing a state where the plug is fixed to the first fixing portion.

Further, the plug 50A is provided with insertion portions 57 to be engaged with rails 27 provided in the first fixing portion 20 when the plug 50A is pulled back from a position before the first fixing portion 20. The insertion portions 57 are provided on the lower surface of the base 58 provided on the plug 50A. As shown in FIG. 10, two insertion portions 57 are provided along opposite left and right edge parts of the base 58 and extend from a rear side of the lock projection 56 to the rear end of the base 58.

Figure 2:
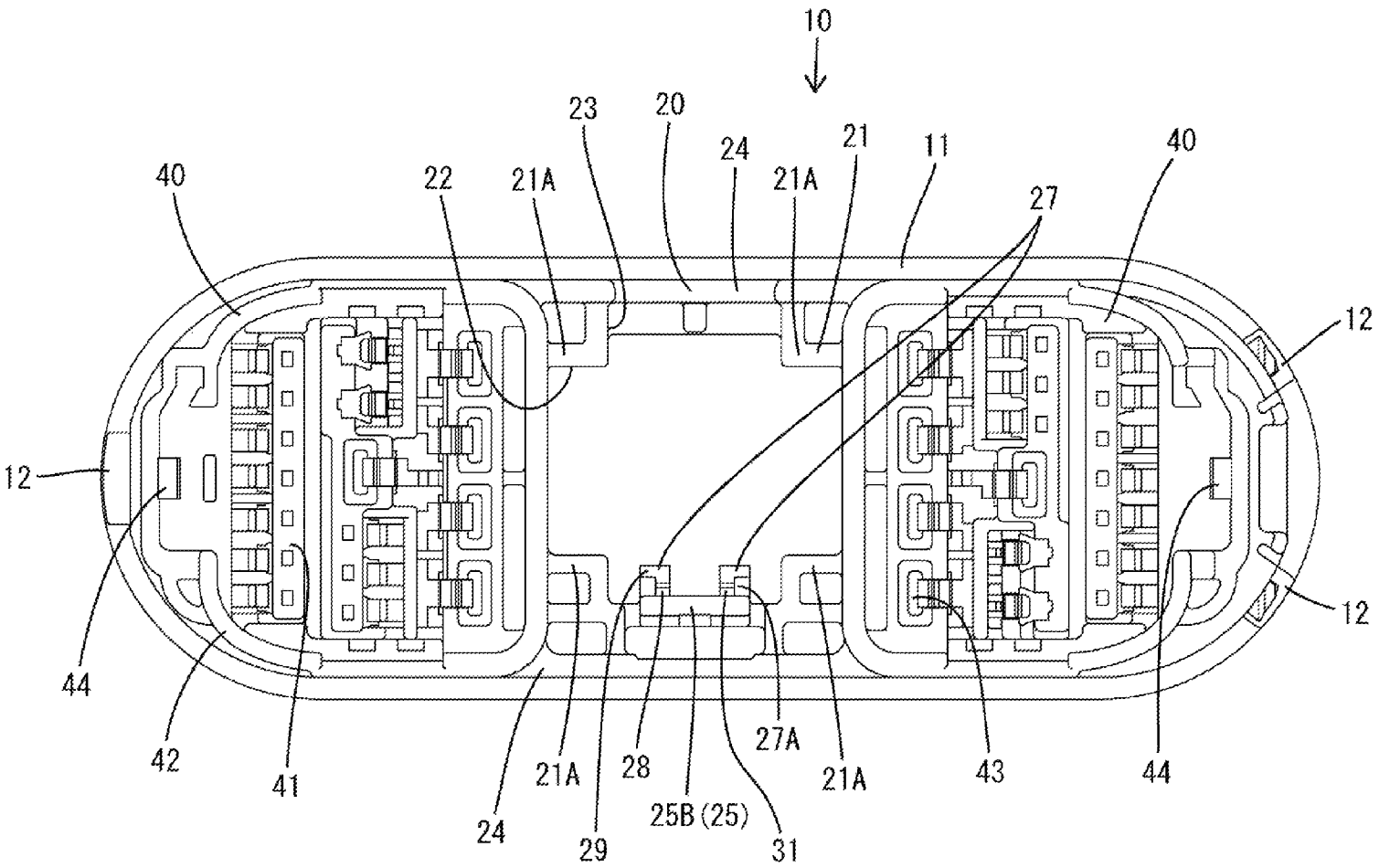
FIG. 2 is a front view showing the connector holder.
Figure 3:
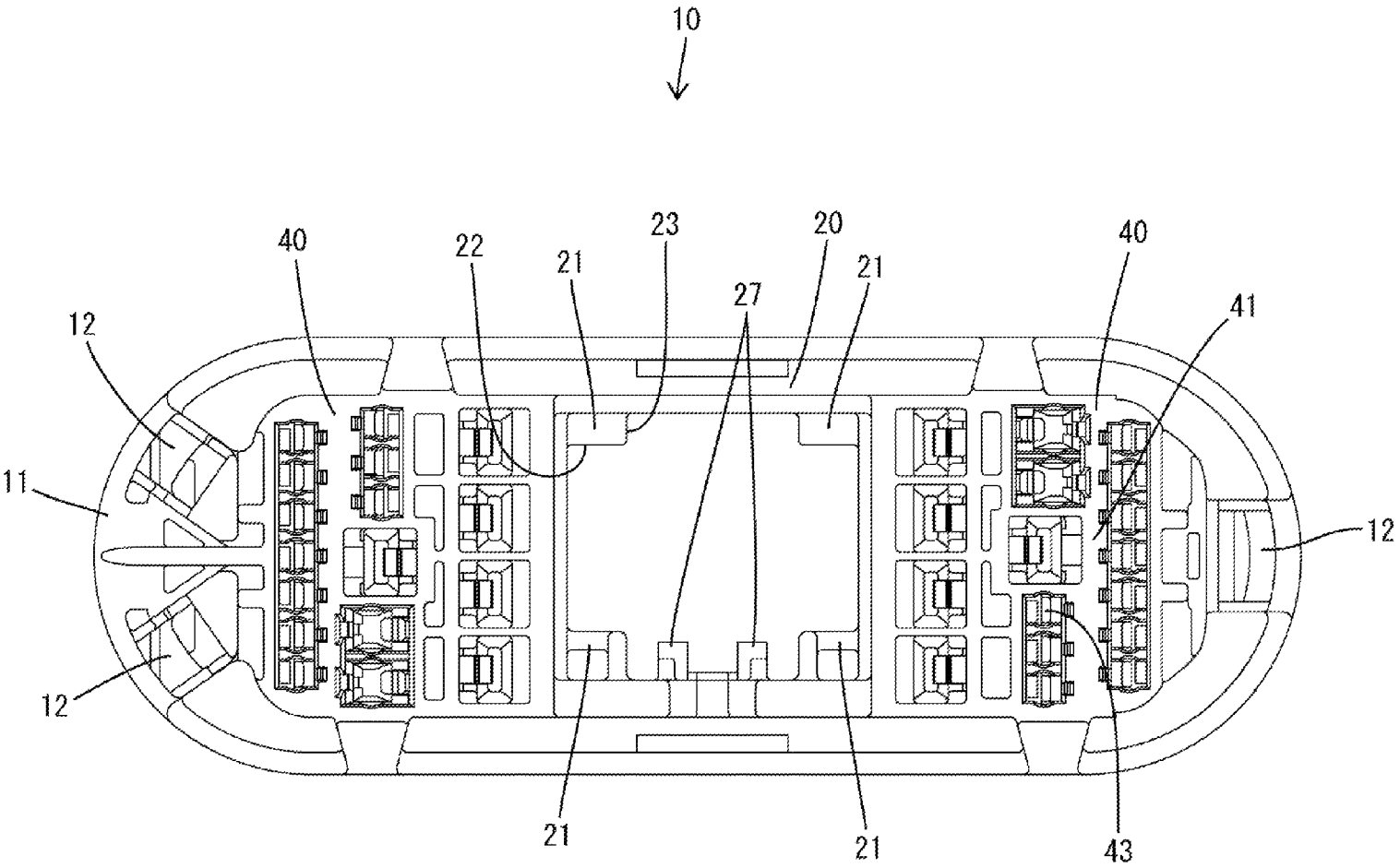
FIG. 3 is a rear view showing the connector holder.

The first fixing portion 20 is open forward and backward and an opening thereof is substantially rectangular when viewed from front. As shown in FIG. 2, block protrusions 21 having a block shape project in on four corner parts of the first fixing portion 20.

A space having a horizontally long rectangular cross-section is formed between the block protrusions 21 on an upper side and the block protrusions 21 on a lower side. This space conforms to a cross-sectional shape of the plug 50A and is a part where the plug 50A passes when being inserted into the first fixing portion 20 from behind (hereinafter, referred to as an inserting portion 22). The inserting portion 22 is one size larger than the cross-section of the plug 50A to enable easy insertion of the plug 50A.

Further, a space having a vertically long rectangular cross-section is formed between the block protrusions 21 on a left side and the block protrusions 21 on a right side. This space conforms to a cross-sectional shape of the connected first connector 50 in a vertical posture and is a part into which the first connector 50 is accommodated by being pulled back from the position before the first fixing portion 20 (hereinafter, referred to as an accommodating portion 23). With the first connector 50 fixed to the first fixing portion 20, the base 58 of the plug 50A is fit between the two block protrusions 21 on the lower side and a front end part of the jack 50B is fit between the pair of block protrusions 21 on the upper side.

Figure 4:
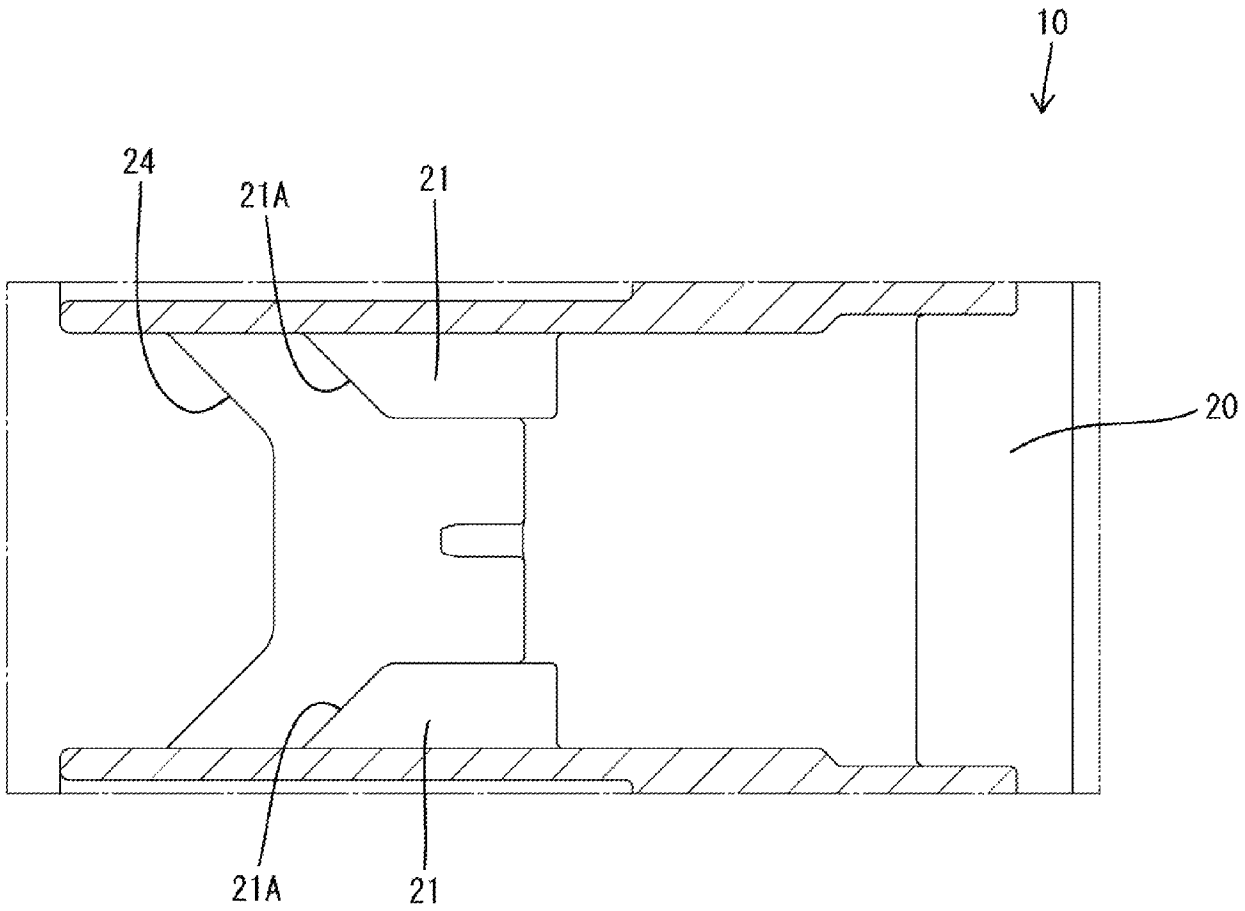
FIG. 4 is a partial enlarged section showing an upper surface side of a first fixing portion.
Figure 5:
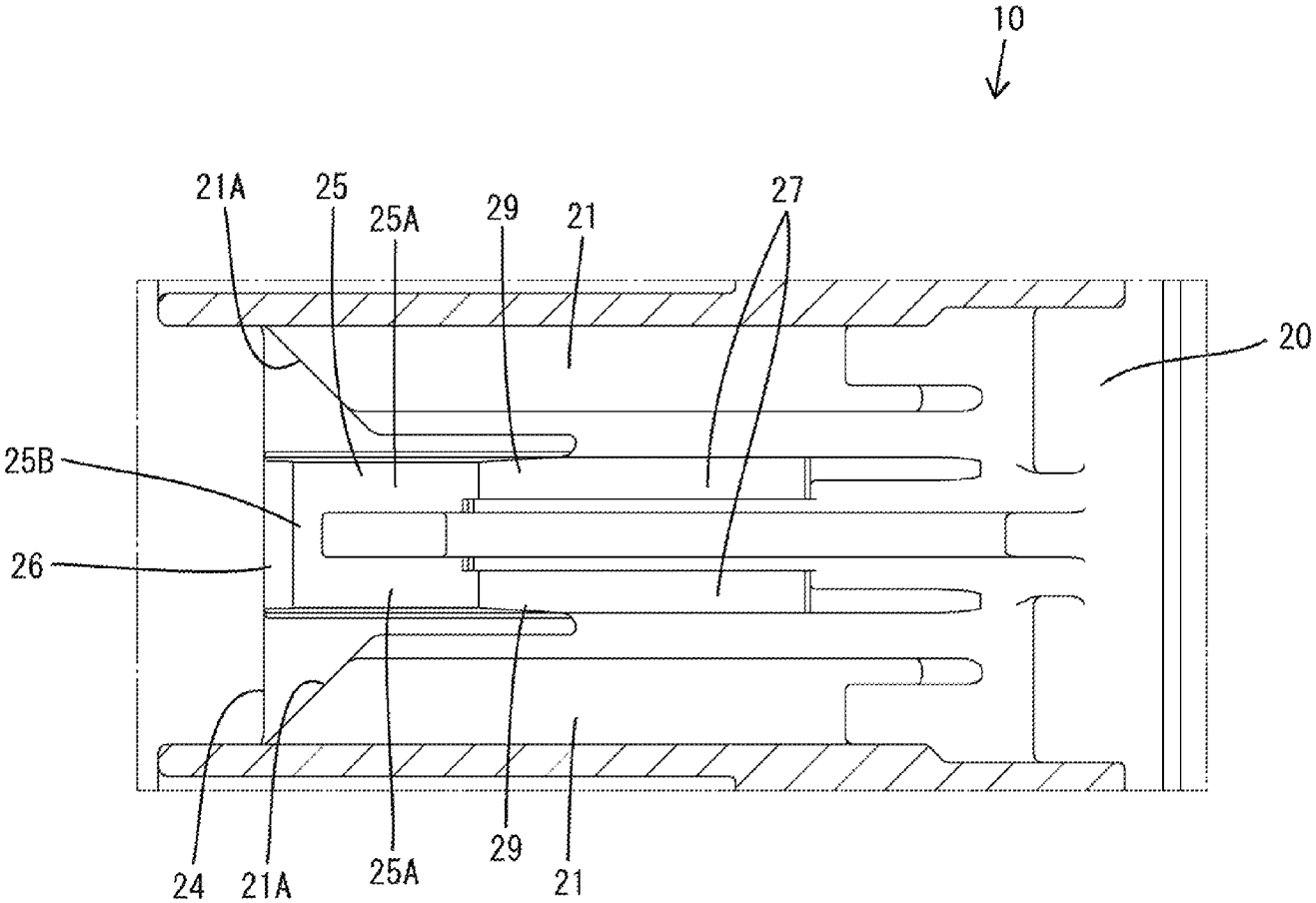
FIG. 5 is a partial enlarged section showing a lower surface side of the first fixing portion.

As shown in FIGS. 4 and 5, the front surface of the block protrusion 21 serves as a guide 21A inclined to narrow a width of the first fixing portion 20 from the front end toward a rear side and is configured to guide a movement of the first connector 50 to the predetermined fixed position. The guide 21A is inclined gradually toward a lateral central side of the first fixing portion 20 from the front end toward the rear.

As shown in FIG. 1, a cut 24 is provided on each of front end parts of the upper and lower walls of the first fixing portion 20. The cut 24 on the upper wall has a trapezoidal shape in a plan view and allows the operating portion 55 of the lock arm 52 of the first connector 50 fixed to the first fixing portion 20 to be open upward. This enables the operating portion 55 to be pressed down to disengage (unlock) the lock arm 52 and the lock 51 so that the jack 50B can be separated easily. The cut 24 on the lower wall has a laterally long rectangular shape in a plan view and is formed over the entire width of the first fixing portion 20, as shown in FIG. 4. By providing this cut portion 24, the front end of the lock piece 25 in the first fixing portion 20 and the front end of the lower wall of the first fixing portion 20 are aligned. This enables the lock piece 25 to be unlocked easily as compared with the case where the lock piece 25 is retracted back from the lower wall of the first fixing portion 20.

As shown in FIG. 7, the first fixing portion 20 is provided with the lock piece 25 to be locked to the lock projection 56 on the plug 50A to restrict forward separation of the plug 50A (first connector 50) from the first fixing portion 20 when the first connector 50 is pulled back and reaches the predetermined fixed position.

The lock piece 25 is formed on a front part of the lower surface (wall surface) of the first fixing portion 20 and located between the two block protrusions 21 on the lower side. As shown in FIG. 5, the lock piece 25 includes two arms 25A extending forward from a substantially central part of the lower surface of the first fixing portion 20 in a front-back direction and a locking portion 25B provided to couple front ends of the arms 25A. The lock piece 25 is a cantilever supported on the rear end and is resiliently deflectable in a vertical direction.

When the first connector 50 is pulled back, the lock projection 56 of the plug 50A contacts the locking portion 25B of the lock piece 25 to displace the lock piece 25 resiliently down. When the first connector 50 reaches the predetermined fixed position, the lock projection 56 moves over the locking portion 25B of the lock piece 25, the lock piece 25 resiliently returns up and the locking portion 25B is locked to a front of the lock projection 56 (see FIG. 7). Note that a leading surface 26 is formed on an upper surface side of the front end of the locking portion 25B and is inclined to lead a movement of the lock projection 56 over the locking portion 25B.

The first fixing portion 20 has the rails 27 for guiding the plug 50A to the predetermined fixed position of the first fixing portion 20 by being engaged with the insertion portions 57 of the plug 50A when the first connector 50 is pulled back. The rails 27 are provided on the lower surface of the first fixing portion 20 (wall surface on a side where the lock piece 25 is formed).

As shown in FIG. 2, each rail 27 includes a groove 27A open sideways, and the insertion portion 57 on the plug 50A is inserted into the groove 27A from the front. Left and right rails 27 extend in the front-back direction. Each rail 27 has a standing portion 28 standing on the lower surface of the first fixing portion 20 and a protruding portion 29 protruding sideways (lateral direction of the first fixing portion 20 toward a side opposite to the central side) from an upper part of the standing portion 28. In a state where the insertion portions 57 of the plug 50A are inserted in the grooves 27A, a lateral displacement of the plug 50A (first connector 50) is restricted by the standing portions 28 and a vertical displacement of the plug 50A (first connector 50) is restricted by the protruding portions 29 and the lower surface of the first fixing portion 20.

As shown in FIGS. 5 and 6, the rails 27 extend from a position behind a center of the first fixing portion 20 in the front-back direction to the upper surfaces of the arm portions 25A of the lock piece 25. The standing portion 28 of each rail 27 stands along an inner side edge (edge on the central side in the lateral direction of the first fixing portion 20) of the arm portion 25A. The protruding portion 29 is extends from a position behind the lock piece 25 to a position overlapping with the lock piece 25 from above.

The standing portion 28 has a slit 31 to separate the lock piece 25 and the protruding portion 29. The slit 31 extends back from the front end of the standing portion 28. The slit 31 is formed on a lower end side of the standing portion 28 while leaving an upper end part of the standing portion 28. The rear end of the slit 31 is near a rear end part of the lock piece 25.

The rail 27 has a stop 32 for restricting backward separation of the first connector 50 (plug 50A) from the first fixing portion 20 by the contact of the insertion portion 57 of the plug 50A therewith as shown in FIG. 7 when the first connector 50 (plug 50A) is pulled back and reaches the predetermined fixed position. The stop 32 is a wall provided to close the rear end of the groove 27A of the rail 27.

The first connector 50 is fixed to the connector holder 10 by initially inserting the plug 50A fixed to the end part of the coaxial cable C into the first fixing portion 20 to project forward (see FIG. 6). Specifically, the plug 50A is set in a laid-down posture (posture in which the lock projection 56 is on a left or right side) by holding the coaxial cable C and inserted into the inserting portion 22 of the first fixing portion 20 from behind so that the entire plug 50A reaches the front side of the first fixing portion 20. At this time, the plug 50A may face left or right.

Subsequently, the first connector 50 is connected (see FIG. 7). The jack 50B fixed to the end part of the coaxial cable C is fit to the plug 50A and the lock arm 52 and the lock portion 51 are locked. The first connector 50 then is pulled back and fixed to the first fixing portion 20 (see FIG. 8). The first connector 50 is pulled backward in the vertical posture (posture in which the lock projection 56 is arranged on the lower side) by holding the coaxial cable C on the side of the plug 50A. Then, the insertion portions 57 of the plug 50A slip under the protruding portions 29 of the rails 27 and are inserted into the groove portions 27A from the front. In this way, the first connector 50 can move back while being positioned in the vertical and lateral directions. The lock projection 56 of the plug 50A then contacts the locking portion 25B of the lock piece 25 and moves over the locking portion 25B by deflecting the lock piece 25 down. The lock piece 25 then resiliently returns up and the locking portion 25B thereof is locked to the front of the lock projection 56 and the insertion portions 57 of the plug 50A contact the stopping portions 32 of the rails 27. In this way, the first connector 50 is fixed at the predetermined fixed position with movements thereof in the front-back direction restricted. Thus, the operation of fixing the first connector 50 to the connector holder 10 is completed.

The connector holder 10 integrally includes the first fixing portion 20 to which the first connector 50 for connecting the coaxial cable C is to be fixed and the second fixing portions 40 to which the second connectors for connecting the wires W different in type from the coaxial cable C are to be fixed. According to this configuration, the first connector 50 for connecting the coaxial cable C and the second connectors for connecting the wires different from the coaxial cable C are fixed to one panel hole via one connector holder 10. Therefore the panel hole can be used commonly by the first connector 50 for connecting the coaxial cable C and the second connectors for connecting the wires different from the coaxial cable C.

The first fixing portion 20 is arranged parallel to and between the second fixing portions 40 and is shaped symmetrically in the arrangement direction. Thus, the connector holder 10 can be used by being reversed in the arrangement direction of the fixing portions 20, 40.

The first fixing portion 20 is open forward and backward. The first connector 50 includes the plug 50A and the jack 50B connectable to each other. The plug 50A is inserted into the first fixing portion 20 from behind while being connected to the end part of the coaxial cable C and is pulled back and fixed to the first fixing portion 20 by pulling the coaxial cable C after projecting forwardly of the first fixing portion 20. The plug 50A and the first fixing portion 20 are provided with rails for guiding the plug 50A to the predetermined fixed position of the first fixing portion 20 by being engaged with each other when the plug 50A is pulled back. The rails enable the plug 50A to be guided to the predetermined fixed position when being pulled back so that the plug 50A can be fixed easily.

The rails 27 have the grooves 27A open sideways and the insertion portions 57 are to be inserted into the grooves 27A. The rails 27 are provided in the first fixing portion 20 and the insertion portions 57 are provided on the plug 50A. Additionally, the rails 27 have the stops 32 for restricting backward separation of the plug 50A from the first fixing portion 20 by the contact of the insertion portions 57 therewith when the plug 50A is pulled back and reaches the predetermined fixed position. Accordingly, backward separation of the plug 50A is restricted by the contact of the insertion portions 57 with the stops 32 so that the plug 50A can be fixed easily.

Further, the plug 50A and the first fixing portion 20 are provided with lock structures for restricting forward separation of the plug 50A from the first fixing portion 20 by being engaged with each other when the plug 50A is pulled back and reaches the predetermined fixed position. The lock structures include the lock projection 56 on the plug 50A and the lock piece 25 in the first fixing portion 20. The lock projection 56 contacts the lock piece 25 to displace the lock piece 25 resiliently, and the plug 50A reaches the predetermined fixed position by pulling back the plug 50A. Thus, the lock projection 56 moves over the lock piece 25 and the lock piece 25 resiliently returns to be locked to the lock projection 56. Accordingly, the lock piece 25 and the lock projection 56 are locked automatically when the pulled-back plug 50A reaches the predetermined fixed position. Therefore, the plug 50A can be fixed easily.

The lock piece 25 is cantilevered forward from the front part of the first fixing portion 20. The rail 27 is provided on the wall surface of the first fixing portion 20 on the side where the lock piece 25 is formed and includes the standing portion 28 standing on the wall surface and the protruding portion 29 protruding sideways from the end part of the standing portion 28 in the standing direction and extending from the position behind the lock piece 25 to the position overlapping with the lock piece 25. The standing portion 28 is provided with the slit 31 to separate the lock piece 25 and the protruding portion 29. If the lock piece and the protruding portion are not separated, the rigidity of the lock piece is high and it is difficult to sufficiently deflect the lock piece. Further, if the protruding portion extends only up to the rear side of the lock piece, the plug is pulled back a longer distance to engage the insertion portions with the rails. Thus, the pulled-back operation becomes difficult. However, according to the configuration of this embodiment, the lock piece 25 and the rail 27 are separated by providing the slit 31 although the rail 27 extends up to the position overlapping with the lock piece 25. Therefore, it is possible to ensure a sufficient a deflection margin of the lock piece 25 and a guide margin of the rail 27.

A connector holder 60 according to a second embodiment of the invention is described with reference to FIGS. 11 to 13. The connector holder 60 of this embodiment differs from the first embodiment in that a guide 61 for guiding a movement of a plug 50A is provided on a front opening of a first fixing portion 20. Note that components similar to those of the first embodiment are denoted by the same reference signs and not repeatedly described.

As in the first embodiment, the connector holder 60 of the second embodiment integrally includes a first fixing portion 20 to which a first connector 50 for connecting a coaxial cable is to be fixed and second fixing portions 40 to which second connectors for connecting wires different from the coaxial cable C are to be fixed.

Further, as in the first embodiment, the connector holder 60 has the first fixing portion 20 arranged in parallel between the second fixing portions 40, and symmetrically shaped in an arrangement direction of the fixing portions.

As in the first embodiment, the first fixing portion 20 is open forward and backward. The plug 50A connected to an end part of the coaxial cable C is inserted into the first fixing portion 20 from behind and pulled back and fixed to the first fixing portion 20 by pulling the coaxial cable C after projecting forwardly of the first fixing portion 20. As in the first embodiment, the first fixing portion 20 is provided with rails 27 for guiding the plug 50A to a predetermined fixed position of the first fixing portion 20 by being engaged with insertion portions 57 of the plug 50A when the plug 50A is pulled back and a lock piece 25 for restricting forward separation of the plug 50A from the first fixing portion 20 by being locked to a lock projection 56 of the plug 50A when the plug 50A is pulled back and reaches the predetermined fixed position.

The guide 61 for guiding a movement of the plug 50A is provided on the front opening of the first fixing portion 20. The guide 61 is an inclined surface inclined to narrow a width of the first fixing portion 20 from the front end of the connector holder 60 toward the rear. The guide 61 includes first guides 62 provided on opposite left and right sides of the front opening of the first fixing portion 20, as shown in FIG. 11, and a second guide 63 provided on an upper side, as shown in FIG. 12.

Figure 11:
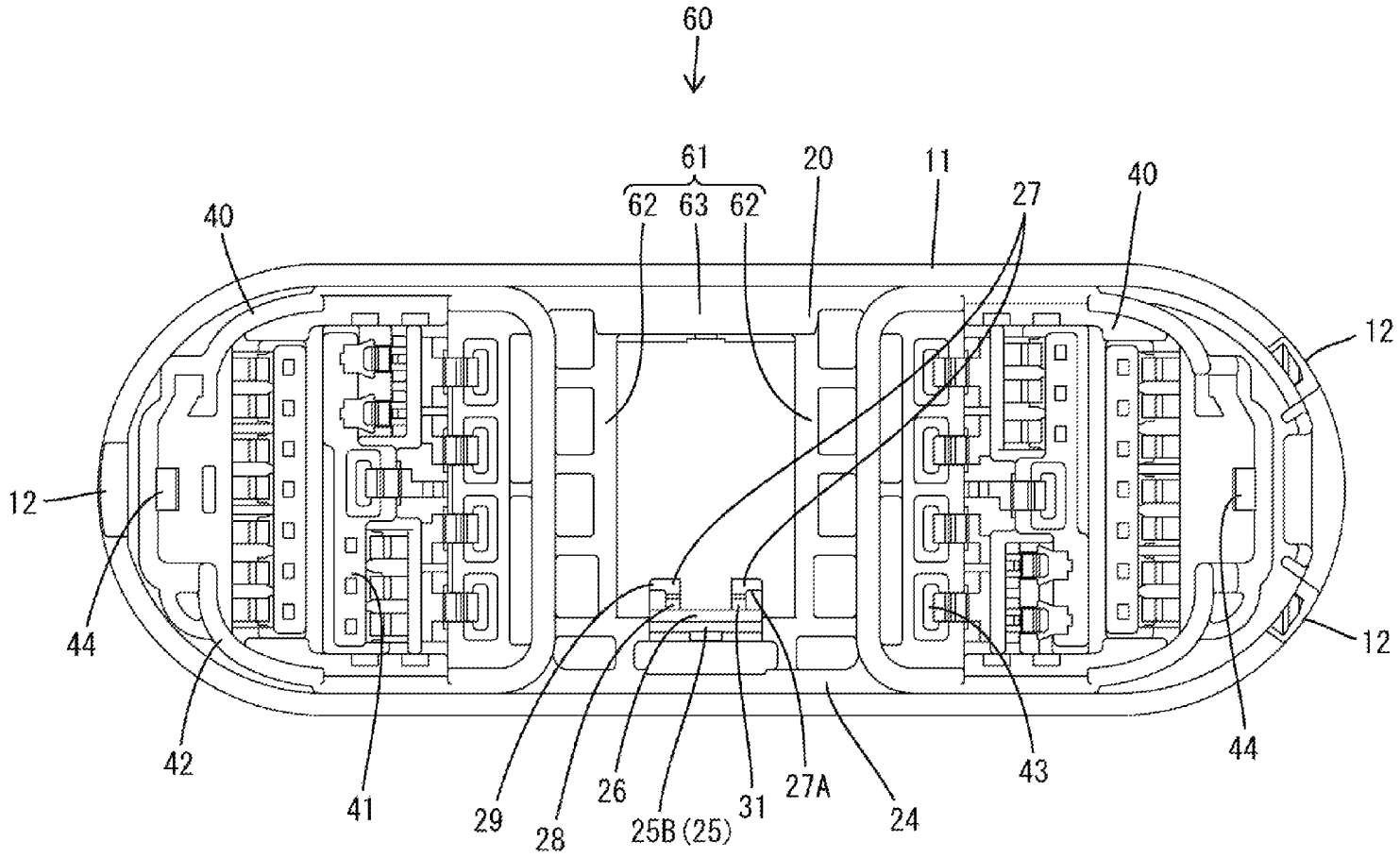
FIG. 11 is a front view showing a connector holder in a second embodiment.

As shown in FIG. 11, the first guides 62 are inclined gradually toward a lateral center of the first fixing portion 20 from the front end of the connector holder 60 (positions proximate to the front surfaces of the second fixing portions 40) toward the rear side. The first guides 62 are formed on opposite lateral end surfaces of a cut 24 on a lower wall. Gradients of the first guides 62 provided on left and right sides are equal. The rear ends of the first guides 62 are behind the front end of the lock piece 25. A distance between the left and right first guides 62 on the rear ends of the first guides 62 is equal to a lateral dimension of the first connector 50. Further, as shown in FIG. 11, the first guides 62 are provided substantially over the entire height of the first fixing portion 20.

Figure 13:
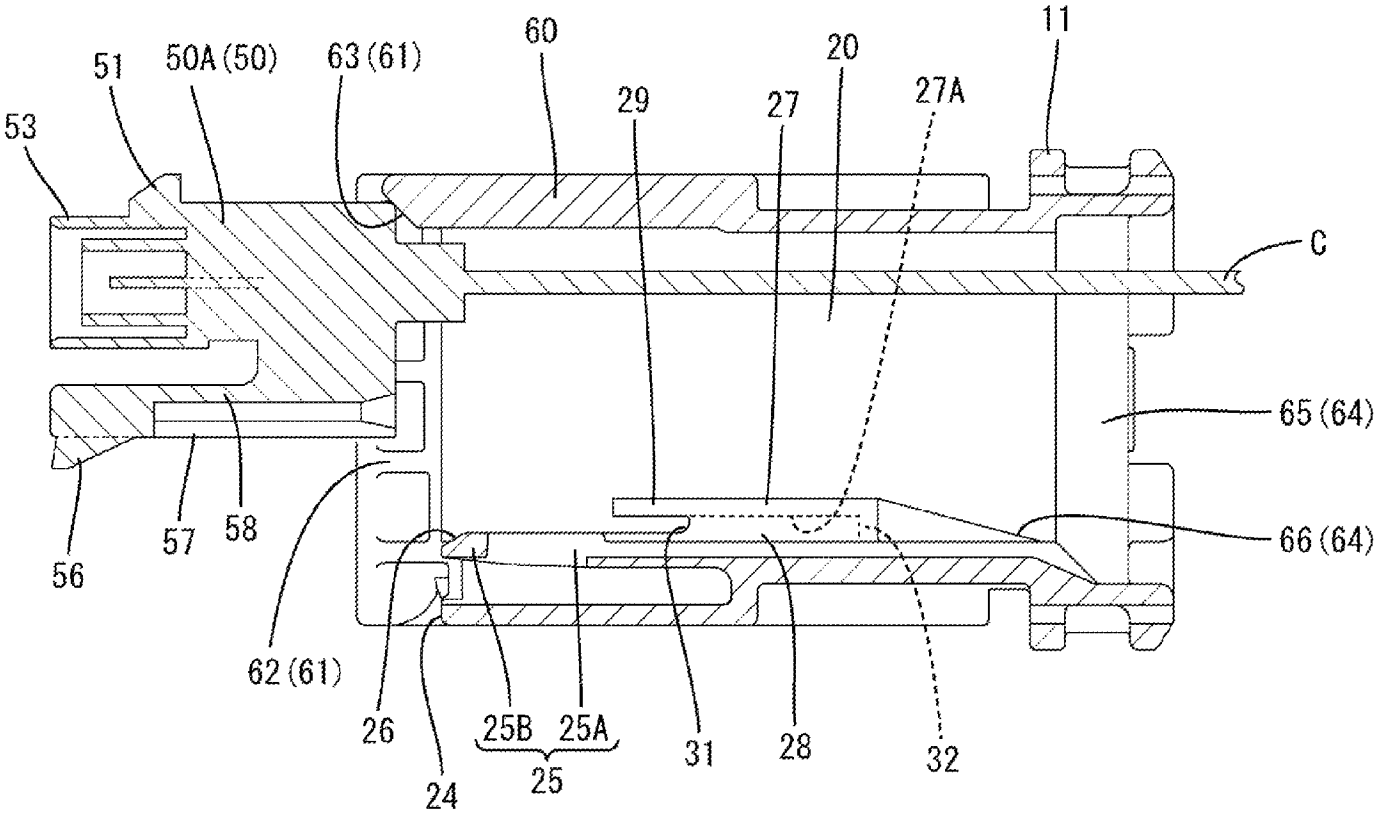
FIG. 13 is a side sectional view showing a state where the plug is guided by a second guide.

As shown in FIG. 13, the second guide 63 is inclined gradually down from the front end of the connector holder 60 toward the rear. As shown in FIG. 11, the second guide 63 is formed over the entire space between the left and right first guides 62.

Figure 12:
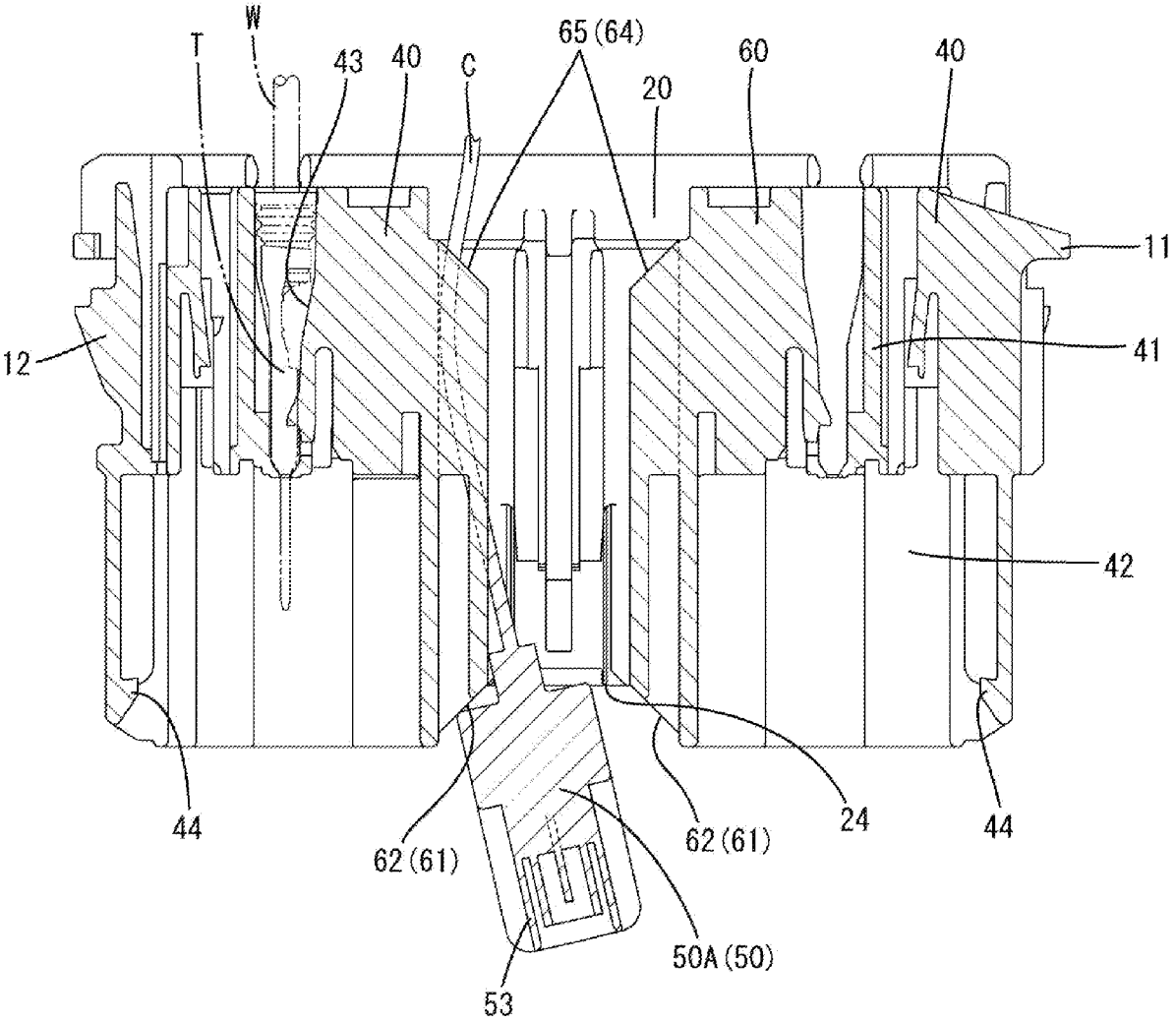
FIG. 12 is a side sectional view showing a state where a plug is guided by a first guide.

A leading portion 64 for leading an inserting operation of the plug 50A into the first fixing portion 20 is provided on a rear end opening of the first fixing portion 20 (see FIGS. 12 and 13). The leading portion 64 is an inclined surface inclined to narrow the width of the first fixing portion 20 from the rear end of the first fixing portion 20 toward a front side. The leading portion 64 includes first leading portions 65 provided on opposite left and right sides of the rear end opening and second leading portions 66 provided on a lower side.

As shown in FIG. 12, the first leading portions 65 are inclined gradually toward the lateral center of the first fixing portion 20 from the rear end of the first fixing portion 20 toward the front side. Gradients of the first leading portions 65 on left and right sides are equal. A distance between the left and right first leading portions 65 on the front ends of the first leading portions 65 is equal to the lateral dimension of the first connector 50. Further, the first leading portions 65 are provided substantially over the entire height of the first fixing portion 20 (see FIG. 13).

Wall surfaces formed between the first guides 62 and the first leading portions 65 are substantially parallel to each other in the lateral direction. Note that the first leading portions 65 and the first guides 62 have equal gradients.

As shown in FIG. 13, the second leading portions 66 are inclined gradually up from the rear end toward the front side. The second leading portions 66 are provided on opposite left and right sides of the first fixing portion 20.

If the plug 50A is displaced with respect to the first fixing portion 20 in the lateral direction when being inserted into the first fixing portion 20 from behind, the plug 50A contacts the first leading portion 65 and the position thereof is corrected by the inclination of the first leading portion 65. Further, if the plug 50A is displaced down with respect to the first fixing portion 20, the plug 50A contacts the second leading portions 66 and the position thereof is corrected by the inclinations of the second leading portions 66. Thus, an operation of inserting the plug 50A into the first fixing portion 20 can be performed easily.

If the plug 50A is displaced laterally with respect to the first fixing portion 20, as shown in FIG. 12 when being pulled back, the plug 50A contacts the first guide 62 and the position thereof is corrected by the inclination of the first guiding portion 62. Further, if the plug 50A is displaced up with respect to the first fixing portion 20 as shown in FIG. 13, the plug 50A comes into contact with the second guide 63 and the position thereof is corrected by the inclination of the second guide 63. Thus, an operation of pulling back the plug 50A into the first fixing portion 20 can be performed easily performed.

As described above, in the second embodiment, the connector holder 60 integrally includes the first fixing portion 20 to which the first connector 50 for connecting the coaxial cable C is to be fixed and the second fixing portions 40 to which the second connectors for connecting the wires W different from the coaxial cable C are to be fixed. Thus, as in the first embodiment, a panel hole can be commonly used by the first connector 50 for connecting the coaxial cable C and the second connectors for connecting the wires different in type from the coaxial cable C.

Further, since the first guides 62 and the second guide 63 inclined to narrow the width of the first fixing portion 20 from front to rear and configured to guide a movement of the plug 50A to the predetermined fixed position are provided on the front opening of the first fixing portion 20, the plug 50A can be easily pulled back to a predetermined position.

The present invention is not limited to the above described and illustrated first and second embodiments. For example, the following embodiments are also included in the technical scope of the present invention.

Although the first connector 50 is pulled back and fixed to the first fixing portion 20 after being connected in both embodiments, there is no limitation to this. The first connector 50 may be connected after the plug 50A is pulled back and fixed to the first fixing portion 20.

Although the first fixing portion 20 is arranged in parallel between the pair of second fixing portions 40 in the first and second embodiments, there is no limitation to this. The numbers and arrangement positions of the first and second fixing portions can be appropriately changed.

Although the rails include the rails 27 with the grooves 27A open sideways and the insertion portions 57 to be inserted into the grooves 27A in the first and second embodiments, there is no limitation to this. The rail structures may be any structures provided that they guide the plug to the predetermined fixed position of the first fixing portion.

Although the lock structures include the lock projection 56 provided on the plug 50A and the lock piece 25 provided in the first fixing portion 20 in the first and second embodiments, there is no limitation to this. The lock structures may be any structures provided that they can fix the plug.

Although the first connector 50 is a FAKRA connector adapted to FAKRA in the first and second embodiments, there is no limitation to this. The present can be adapted also when the first connector is not a FAKRA connector.

LIST OF REFERENCE SIGNS

C . . . coaxial cable
W . . . wire
10, 60 . . . connector holder
20 . . . first fixing portion
25 . . . lock piece
27 . . . rail
27A . . . groove portion
28 . . . standing portion
29 . . . protruding portion
31 . . . slit
32 . . . stop
40 . . . second fixing portion
50 . . . first connector
50A . . . plug (one connector)
50B . . . jack
56 . . . lock projection
57 . . . insertion portion
61 . . . guiding portion

What is claimed is:

1. A connector holder, comprising:

a first fixing portion to which a first connector for connecting a coaxial cable is to be connected; and a second fixing portion to which a second connector for connecting a wire different in type from the coaxial cable is to be fixed, the first fixing portion and the second fixing portion being integral to each other, wherein the first fixing portion is open forward and backward;

the first connector includes two connectors connectable to each other;

one of the two connectors is inserted into the first fixing portion from behind while connected to an end part of the coaxial cable and pulled back and fixed to the first fixing portion by pulling the coaxial cable back after projecting forward of the first fixing portion; and the one connector and the first fixing portion include rail structures for guiding the one connector to a predetermined fixed position of the first fixing portion by being engaged with each other when the one connector is pulled back.

2. The connector holder of claim 1, wherein the first fixing portion is parallel to and between a pair of the second fixing portions and the connector holder is symmetrically shaped in an arrangement direction of the fixing portions.

3. The connector holder of claim 1, wherein:

the rail structures include a rail with a groove open sideways and an insertion portion to be inserted into the groove;

the rail is provided in the first fixing portion and the insertion portion is provided on the one connector; and the rail includes a stop for restricting backward separation of the one connector from the first fixing portion by contact of the insertion portion) therewith when the one connector is pulled back and reaches the predetermined fixed position.

4. The connector holder of claim 1, wherein the one connector and the first fixing portion include lock structures for restricting forward separation of the one connector from the first fixing portion by being engaged with each other when the one connector is pulled back and reaches the predetermined fixed position.

5. The connector holder of claim 4, wherein:

the lock structures include a lock projection provided on the one connector and a lock piece provided in the first fixing portion; and the lock projection moves over the lock piece and the lock piece resiliently returns to be locked to the lock projection when the lock projection contacts the lock piece to resiliently displace the lock piece and the one connector reaches the predetermined fixed position in pulling back the one connector.

6. The connector holder of claim 5, wherein:

the lock piece is in the form of a cantilever supported on a rear end and formed in a front part of the first fixing portion;

the rail is provided on a wall surface of the first fixing portion on a side where the lock piece is formed and includes a standing portion standing on the wall surface and a protruding portion protruding sideways from an end part of the standing portion in a standing direction and extending from a position behind the lock piece to a position overlapping with the lock piece; and the standing portion includes a slit to separate the lock piece and the protruding portion.

7. The connector holder of claim 1, further comprising a guide provided on a front opening of the first fixing portion, the guide being inclined to narrow a width of the first fixing portion from the front to rear and configured to guide a movement of the one connector to the predetermined fixed position.

8. A connector holder having opposite front and rear ends and comprising:

a first fixing portion open from the front end to the rear end of the holder and configured to have first and second mated coaxial connectors mounted therein with a first coaxial cable connected to the first coaxial connector extending from the front end of the first fixing portion and a second coaxial cable connected to the second coaxial connector extending from the rear end of the first fixing portion; and at least one second fixing portion unitary with the first fixing portion, the second fixing portion having a housing adjacent the rear end of the holder and a receptacle adjacent the front end of the holder, the housing having a plurality of cavities extending therethrough from the rear end of the holder to the receptacle, the cavities being configured for accommodating terminal fittings therein, the receptacle being configured to receive a mating connector of a type other than a coaxial connector so that mating terminal fittings in the mating connector can connect electrically with the terminal fittings in the housing.

9. The connector holder of claim 1, wherein the first fixing portion is parallel to and between a pair of the second fixing portions and the connector holder is shaped symmetrically in an arrangement direction of the fixing portions.

10. A connector holder having opposite front and rear ends and comprising:

a first fixing portion open from the front end to the rear end of the holder;

first and second mated coaxial connectors mounted in the first fixing portion with a first coaxial cable connected to the first coaxial connector extending from the front end of the first fixing portion and a second coaxial cable connected to the second coaxial connector extending from the rear end of the first fixing portion; and at least one second fixing portion unitary with the first fixing portion, the second fixing portion having a housing adjacent the rear end of the holder and a receptacle adjacent the front end of the holder, the housing having a plurality of cavities extending therethrough from the rear end of the holder to the receptacle, terminal fittings mounted respectively in the cavities so that wires connected to the terminal fittings extend from the rear end of the connector, the receptacle being configured to receive a mating connector of a type other than a coaxial connector so that mating terminal fittings in the mating connector can connect electrically with the terminal fittings in the housing.

11. The connector holder of claim 10, wherein the first fixing portion is parallel to and between a pair of the second fixing portions and the connector holder is shaped symmetrically in an arrangement direction of the fixing portions.

* * * * *